US009664464B2

(12) United States Patent
Pysarenko

(10) Patent No.: US 9,664,464 B2
(45) Date of Patent: May 30, 2017

(54) BREECH MECHANISM OF A PISTOL WITH SEMI FREE SLIDE

(71) Applicant: Viktor Pysarenko, Vinnitsya (UA)

(72) Inventor: Viktor Pysarenko, Vinnitsya (UA)

( * ) Notice: Subject to any disclaimer, the term of this patent is extended or adjusted under 35 U.S.C. 154(b) by 0 days.

(21) Appl. No.: 14/913,992

(22) PCT Filed: Jan. 24, 2014

(86) PCT No.: PCT/UA2014/000008
§ 371 (c)(1),
(2) Date: Feb. 23, 2016

(87) PCT Pub. No.: WO2015/030693
PCT Pub. Date: Mar. 5, 2015

(65) Prior Publication Data

US 2016/0216054 A1 Jul. 28, 2016

(30) Foreign Application Priority Data

Aug. 27, 2013 (UA) ..... a 2013 10456

(51) Int. Cl.
*F41A 3/00* (2006.01)
*F41A 5/04* (2006.01)

(52) U.S. Cl.
CPC . *F41A 3/00* (2013.01); *F41A 5/04* (2013.01)

(58) Field of Classification Search
USPC ..... 89/187.02, 162, 163, 164, 173, 174; 42/16, 28
See application file for complete search history.

(56) References Cited

U.S. PATENT DOCUMENTS

| | | | | |
|---|---|---|---|---|
| 3,504,594 A | | 4/1970 | Greeley | |
| 4,213,261 A | * | 7/1980 | Claypool | F41A 3/40 42/16 |
| 5,050,481 A | * | 9/1991 | Knight, Jr. | F41A 5/06 42/69.02 |
| 5,425,300 A | * | 6/1995 | Ghisoni | F41A 5/04 89/163 |
| 5,913,262 A | * | 6/1999 | Keppeler | F41A 3/34 89/186 |
| 2005/0229772 A1 | | 10/2005 | Mayerl | |

FOREIGN PATENT DOCUMENTS

| | | |
|---|---|---|
| EP | 1559984 | 8/2005 |
| GB | 673028 | 5/1952 |

* cited by examiner

*Primary Examiner* — J. Woodow Eldred
(74) *Attorney, Agent, or Firm* — Weiner & Burt, P.C.; Irving M. Weiner; Pamela S. Burt

(57) ABSTRACT

Invention refers to a breech mechanism of a pistol with a barrel which is tilting during the recoil. Barrel (1) ledge (3) at the bottom has long slots (7), placed along its lateral surfaces, which intrude in corresponding guides (8), performed in frame (5), and the front side of the barrel (1) is placed in the slide (4) guiding hole 6.Besides that, barrel (1) ledge (3) has opened transverse slot (9) with radial edges, situated with bottom-upward tilt and close lateral hole (13). In the long slot (9) the roller (10) is placed, which is pressed up by the spring (11), situated at the closed hole (13), closed by the socket (12). On the inner sidewalls of the frame (5) bevels (14) are performed, on which the roller (10) ends are sliding and on the inner sidewalls of the slide (4) cuts (15) are performed, wherein the roller (10) ends intrude, when the slide (4) is on the forward position.

16 Claims, 3 Drawing Sheets

C - C

BREECH MECHANISM OF A PISTOL WITH SEMI FREE SLIDE

Figure 1:
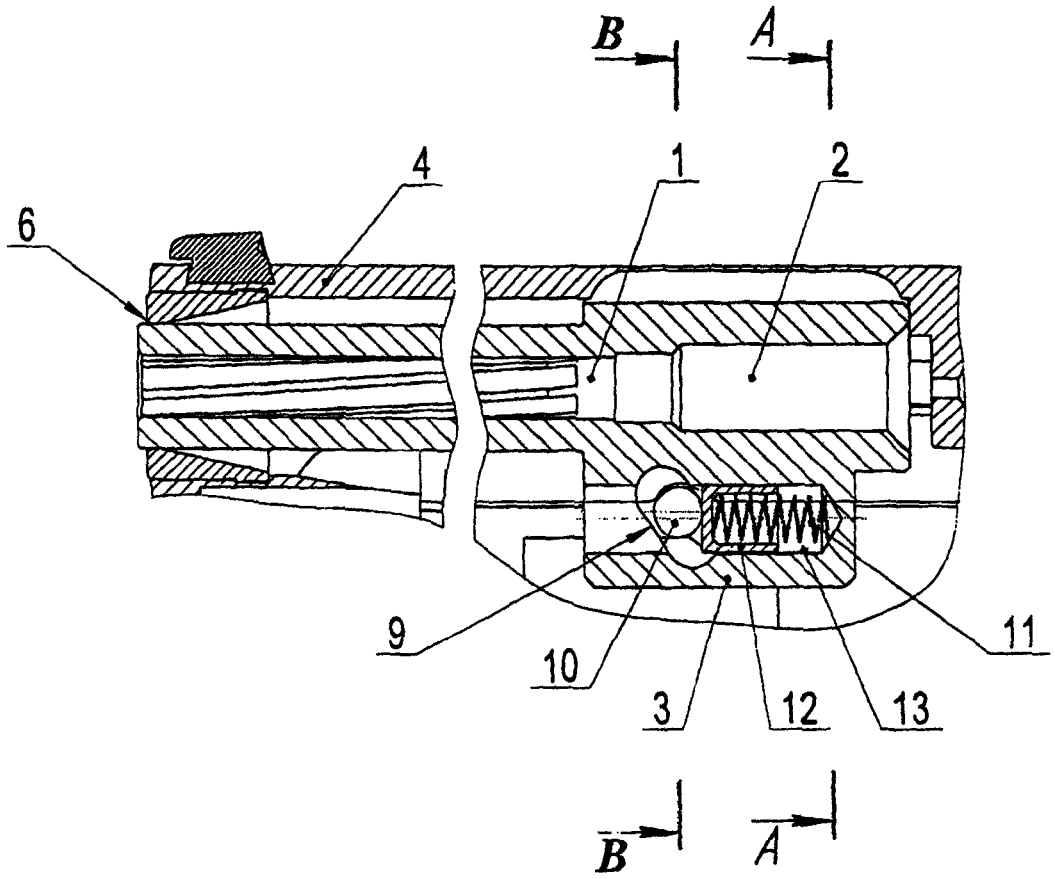

Invention refers to the armament industry, namely to rolling type pistol breech mechanism.

Most similar analog of the announced invention is "GLOCK 17" pistol breech mechanism (electronic internet-encyclopedia "Wikipedia"; gunmagazine.com "GLOCK 17 Pistol").

Known pistol breech mechanism at short barrel stroke ensures the barrel junction with the slide by means of curved lever, which bottom is fixed in the frame with turn capability. Herewith, top of the lever is pinned by means of spring to the forward edge of the rectangular notch of the slide and the lever curve is thrust against the barrel ledge front walls.

When the slide is moving back, the slide and barrel are moving together and lever is turning about axis. At that, top of the lever steps down and emerges from the slide clutch, insuring the barrel back motion stop and slide with barrel detach.

The main problem of such breech mechanism is the presence of considerable friction surface between slide and top of the lever and between barrel ledge and lever curve. Therewith, such design provides the immediate barrel stop at detaching with slide.

At the hart of invention is the goal to create the breech mechanism of the pistol, which will ensure considerable parts friction reduction, smooth slide and barrel detach, increase the case ejection reliability during the shot and slide operation reliability at recoil and return (slide motion during the shot).

Set task solution is ensured that the pistol breech mechanism, which consist of barrel, having the down-directed ledge, herewith the front side of the barrel is placed in slide lead hole and the rear side is kept by the cross pin, fastened in the frame and comes into opened transverse slot in barrel ledge. Therewith, rectangular cut is done at the slide bottom. Pursed by the spring top end of the curved toggle is pinned to the front side of the cut and the other end of the lever is fixed in the frame with turn possibility. At that, the lever curve is rested against the front side of down-directed barrel ledge, according to the invention, the rear side of down-directed barrel ledge is performed with long grooves, which intrude to the frame guide lugs. Therewith, through groove is provided in the barrel ledge, performed with bottom-upwards descent, wherein cylindrical roller is put, at that, the roller ends intrude in inclined ways inside the frame, when the slide in its forward position, the roller ends intrude into semi-circular slide holes, therewith, spring is placed in the barrel ledge closed hole, closed by the socket, which purses the roller up.

Namely these properties are necessary and sufficient for the set task solution.

The fact that the roller has cylindrical form, slides on the frame grooves and barrel transverse slot, allows the considerable friction reduction at the barrel with slide detach and the different slot tilt angles in barrel ledge, where the roller center is moving and frame bevels tilt, wherein the roller ends are moving are matched such that the slow barrel stop is ensured after the detach with slide, increasing the case ejection reliability during the shot.

The invention essence is shown on figures:

FIG. 1—breech mechanism longitudinal section

Figure 2:
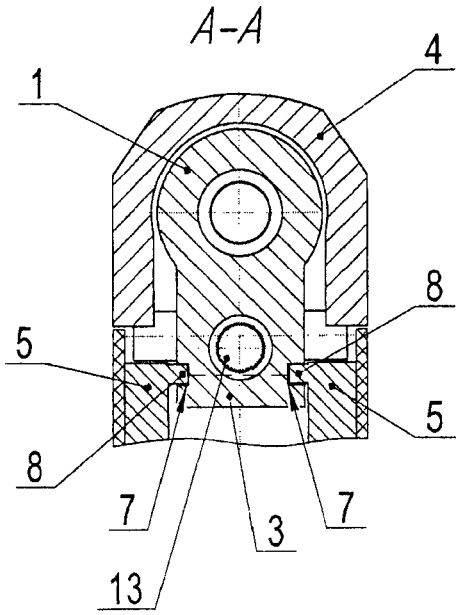

FIG. 2—section by A-A on FIG. 1.

Figure 3:
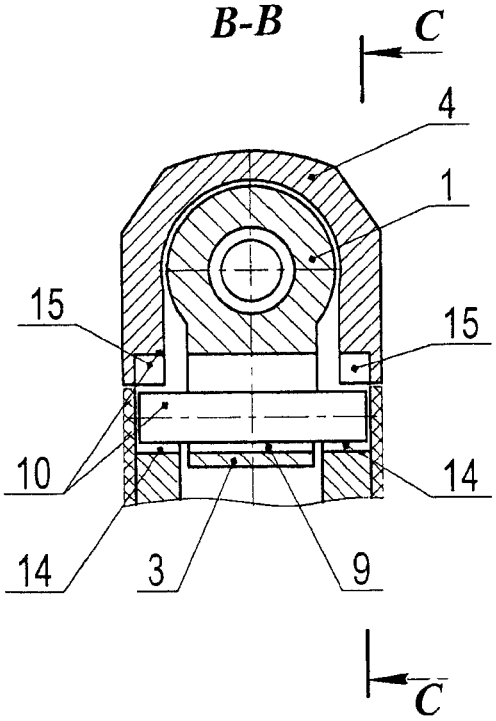

FIG. 3—section by B-B on FIG. 1.

Figure 4:
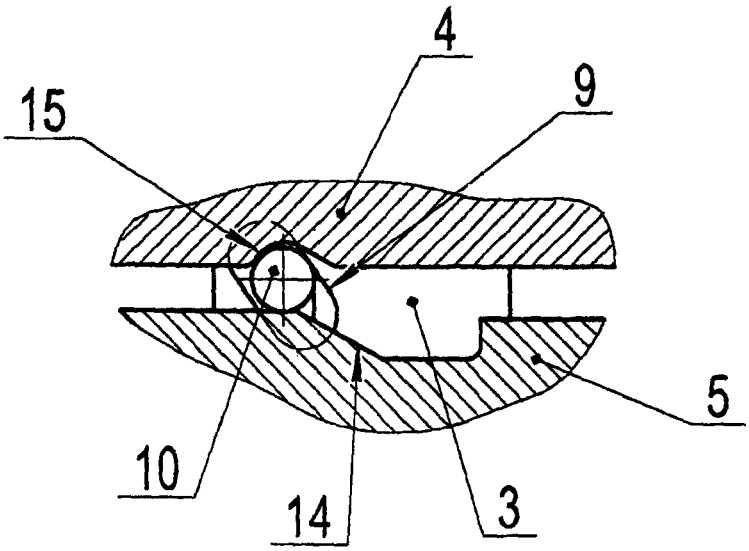

FIG. 4—section by C-C on FIG. 3 (the slide is in forward position, joined with barrel).

Figure 5:
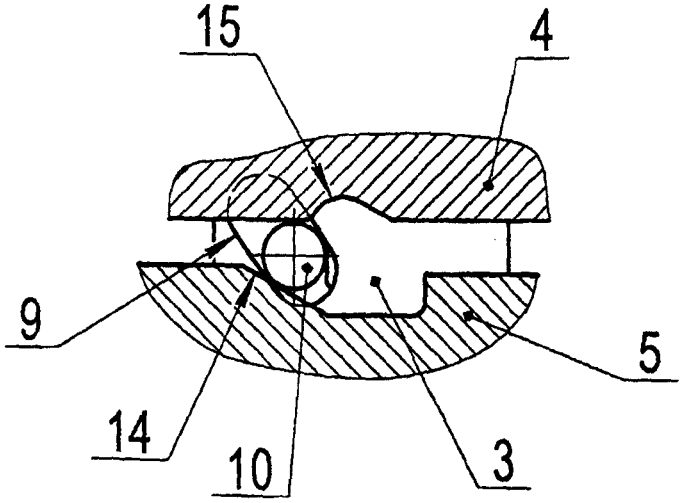

FIG. 5—section by C-C on FIG. 3 (slide is moving backwards and detached with barrel).

Pistol breech mechanism consists of the barrel 1, performed with the cartridge chamber 2, ledge 3, performed at the rear side and directed down, slide 4 and frame 5.

Barrel 1 ledge 3 at the bottom has long slots 7, placed along its lateral surfaces, which intrude in corresponding guides 8, performed in frame 5, and the front side of the barrel 1 is placed in the slide 4 guiding hole 6.

Besides that, barrel 1 ledge 3 has opened transverse slot 9 with radial edges, situated with bottom-upward tilt and close lateral hole 13. In the long slot 9 the roller 10 is placed, which is pressed up by the spring 11, situated at the closed hole 13, closed by the socket 12. On the inner sidewalls of the frame 5 bevels 14 are performed, on which the roller 10 ends are sliding and on the inner sidewalls of the slide 4 cuts 15 are performed, wherein the roller 10 ends intrude, when the slide 4 is on the forward position.

Breech Mechanism Position at Barrel with Slide Junction and Detach

When the slide 4 is on forward position, the barrel 1 and slide 4 are joined by the roller 10. Roller 10 is pressed by the spring 11 to the slide 4 cuts 15 and fastened between slide 4 cuts 15 and horizontal surface of the frame 5 bevels 14, which ensures the barrel 1 junction with the slide 4.

When the slide 4 is moving back, roller 10 slides between the slide 4 cuts 15 and horizontal surface of the frame 5 bevels 14, at that the barrel 1 remains joined with the slide 4 until the roller 10 ends achieve the frame 5 bevels 14 inclines. When the roller 10 ends, moving on the frame 5 bevels 14 inclines are emerge from the slide 4 cuts, the barrel 1 stops and the slide 4 continue moving backwards, insuring the slide 4 and barrel 1 detach.

Besides that, the frame 5 bevels 14 tilt angles and slot 9 tilt in the barrel 1 ledge 3, where the roller 10 is moving are different, insuring the slow barrel 1 stop after its detach with the slide 4.

Reference design bundle is developed for the proposed breech mechanism structure. Design is technologically processed. Above mentioned breech mechanism test samples are manufactured and tested; testing results are positive.

The invention claimed is:

1. A breech mechanism for a pistol having a barrel which tilts during recoil, comprising, in combination:

a pistol frame provided with guides therein, and bevel portions each having a horizontal surface and incline sections;

a cartridge chamber;

a pistol slide member having a slide guide hole member disposed therewithin and slide cut portions;

a pistol barrel disposed within said pistol slide member with a front portion of said barrel placed in said slide guide hole member;

said pistol barrel having a ledge member at a bottom of said barrel;

said barrel ledge member being providing with elongated slots disposed along lateral surfaces of said barrel ledge member;

said frame guides engage with said elongated slots;

said barrel ledge member having a transverse slot therein and a lateral hole member closed by a socket member;

a spring disposed in said lateral hole member; and a cylindrical roller placed in said transverse slot and pressed by said spring to slide on said frame bevel portions and to intrude in said slide cut portions when said pistol slide member is in a forward position.

2. The mechanism of claim 1, wherein:

when said slide member is in said forward position, said barrel and slide member are releasably connected together by said cylindrical roller; and whereby said cylindrical roller is pressed by said spring to said slide cut portions and temporarily connected between said slide cut portions and said horizontal surface of said frame bevel portions to provide a releasable junction between said barrel and said slide member.

3. The mechanism of claim 1, wherein:

when said slide member is moving backwardly, said cylindrical roller slides between said slide cut portions and said horizontal surface of said frame bevel portions while said barrel remains releasably connected to said slide member until said cylindrical roller reaches said frame bevel incline sections; and whereby when said cylindrical roller emerges from said slide cut portions, said barrel stops and said slide member continues to move backwardly to ensure that said slide member detaches from said barrel.

4. The mechanism of claim 2, wherein:

when said slide member is moving backwardly, said cylindrical roller slides between said slide cut portions and said horizontal surface of said frame bevel portions while said barrel remains releasably connected to said slide member until said cylindrical roller reaches said frame bevel incline sections; and whereby when said cylindrical roller emerges from said slide cut portions, said barrel stops and said slide member continues to move backwardly to ensure that said slide member detaches from said barrel.

5. The mechanism of claim 1, wherein:

said slide cut portions comprise semicircular slide holes.

6. The mechanism of claim 2, wherein:

said slide cut portions comprise semicircular slide holes.

7. The mechanism of claim 3, wherein:

said slide cut portions comprise semicircular slide holes.

8. The mechanism of claim 4, wherein:

said slide cut portions comprise semicircular slide holes.

9. The mechanism of claim 1, wherein:

said frame bevel portions are disposed at a first tilt angle; and said barrel ledge transverse slot is disposed at a second tilt angle which differs from said first tilt angle in a predetermined manner to ensure a slow stopping of said barrel after said barrel detaches from said slide member.

10. The mechanism of claim 2, wherein:

said frame bevel portions are disposed at a first tilt angle; and said barrel ledge transverse slot is disposed at a second tilt angle which differs from said first tilt angle in a predetermined manner to ensure a slow stopping of said barrel after said barrel detaches from said slide member.

11. The mechanism of claim 3, wherein:

said frame bevel portions are disposed at a first tilt angle; and said barrel ledge transverse slot is disposed at a second tilt angle which differs from said first tilt angle in a predetermined manner to ensure a slow stopping of said barrel after said barrel detaches from said slide member.

12. The mechanism of claim 4, wherein:

said frame bevel portions are disposed at a first tilt angle; and said barrel ledge transverse slot is disposed at a second tilt angle which differs from said first tilt angle in a predetermined manner to ensure a slow stopping of said barrel after said barrel detaches from said slide member.

13. The mechanism of claim 5, wherein:

said frame bevel portions are disposed at a first tilt angle; and said barrel ledge transverse slot is disposed at a second tilt angle which differs from said first tilt angle in a predetermined manner to ensure a slow stopping of said barrel after said barrel detaches from said slide member.

14. The mechanism of claim 6, wherein:

said frame bevel portions are disposed at a first tilt angle; and said barrel ledge transverse slot is disposed at a second tilt angle which differs from said first tilt angle in a predetermined manner to ensure a slow stopping of said barrel after said barrel detaches from said slide member.

15. The mechanism of claim 7, wherein:

said frame bevel portions are disposed at a first tilt angle; and said barrel ledge transverse slot is disposed at a second tilt angle which differs from said first tilt angle in a predetermined manner to ensure a slow stopping of said barrel after said barrel detaches from said slide member.

16. The mechanism of claim 8, wherein:

said frame bevel portions are disposed at a first tilt angle; and said barrel ledge transverse slot is disposed at a second tilt angle which differs from said first tilt angle in a predetermined manner to ensure a slow stopping of said barrel after said barrel detaches from said slide member.

* * * * *